United States Patent [19]

Bustos

[11] Patent Number: 5,014,862

[45] Date of Patent: May 14, 1991

[54] ASSEMBLY FOR CANTILEVERED DISPLAY HEADER

[75] Inventor: Rafael T. Bustos, Alpharetta, Ga.

[73] Assignee: Leggett & Platt, Incorporated, Carthage, Mo.

[21] Appl. No.: 531,007

[22] Filed: May 31, 1990

[51] Int. Cl.[5] ..... A47F 5/00

[52] U.S. Cl. ..... 211/193; 211/189; 211/207; 248/201; 248/286

[58] Field of Search ..... 211/193, 189, 168, 171, 211/207, 100; 248/201, 286

[56] References Cited

U.S. PATENT DOCUMENTS

| | | | |
|---|---|---|---|
| 691,840 | 1/1902 | Chinnery . | |
| 1,644,663 | 10/1927 | Austin . | |
| 1,743,110 | 1/1930 | Broughton . | |
| 1,764,639 | 6/1930 | Nathansohn . | |
| 2,916,234 | 12/1959 | Bogar | 248/286 X |
| 2,923,506 | 2/1960 | Simons | 248/201 X |
| 3,080,980 | 3/1963 | Gibbons . | |
| 3,200,961 | 8/1965 | Kolster et al. . | |
| 3,601,256 | 8/1971 | Bowers et al. | 211/193 X |
| 4,403,554 | 9/1983 | Valentine et al. | 211/189 X |
| 4,460,097 | 7/1984 | Darnell et al. . | |
| 4,461,388 | 7/1984 | Bustos . | |
| 4,541,675 | 9/1985 | Everett | 211/189 X |
| 4,611,866 | 9/1986 | Everett | 211/189 X |
| 4,633,788 | 1/1987 | Robertson | 211/189 X |
| 4,653,651 | 3/1987 | Flum . | |
| 4,667,914 | 5/1987 | Bailey | 248/286 |
| 4,705,175 | 11/1987 | Howard et al. . | |

*Primary Examiner*—Robert W. Gibson, Jr.
*Attorney, Agent, or Firm*—Wood, Herron & Evans

[57] ABSTRACT

An assembly for cantilevered connection of a display header to a gondola display rack includes two uprights braced to the gondola display rack in vertical spaced relation. Each upright rigidly supports a cantilevered arm that includes a lower section and an upper section hingedly raisable with respect to the lower section. Brackets located at the free ends of the upper sections are adapted to support the sides of a triangularly shaped display header. The upper sections may be hingedly raised with respect to the lower sections to independently vary the vertical level of the ends of the mounted display header. By providing two brackets on the hingedly raisable upper sections, the assembly accommodates quick and easy connection and disconnection of two display headers located side-by-side in a row at the desired vertical height.

19 Claims, 3 Drawing Sheets

ASSEMBLY FOR CANTILEVERED DISPLAY HEADER

FIELD OF THE INVENTION

This invention relates to an assembly for cantilevered connection of a display header to a gondola display rack.

BACKGROUND OF THE INVENTION

Most stores and supermarkets employ racks and/or shelves to display products offered for sale. Quite often competing products are located side-by-side on these racks. To call attention to the location of a particular product, a producer of a product may provide a display header to be mounted above the product. Such a display header may be an illuminated box with a light mounted inside or a box or triangle with an opening at the top and an internal mirror that internally reflects light to the front face of the header.

Display headers are typically mounted in cantilevered fashion to stand up vertical displays, often referred to as gondola racks or gondola display racks. U.S. Pat. No. 4,461,388 in the name of Bustos is representative of prior constructions for mounting a display header to a gondola display rack. While display header constructions of this type are suitable for most purposes, mounting methods have proved inconvenient, often requiring manipulation of rigid fasteners in a raised vertical plane. This inconvenience becomes particularly noticeable when two or more of these display headers are to be placed side-by-side, in a row. Once in place, it is difficult to change these side-by-side headers without rearranging the entire row of racks.

Another limitation associated with display header mounting arrangements of this type relates to the fact that the display header always remains a fixed distance above the uppermost shelf. For some items on sale that are rather tall with respect to the clearance distance between the uppermost shelf and the bottom of the display header, this may present a problem.

It is therefore an object of this invention to provide an improved structure and method for cantilevered mounting of a display header to a gondola display rack.

It is still another object of this invention to provide a structure and method for accommodating convenient side-by-side cantilevered mounting of two or more display headers to side-by-side gondola racks.

It is still another object of this invention to provide a display header mounting assembly which is sturdy, convenient, yet vertically adjustable to accommodate use of the gondola display rack for different product sizes.

SUMMARY OF THE INVENTION

This invention contemplates an assembly for cantilevered mounting of a display header to a gondola rack wherein the sides of the display header slidably mount to brackets at the free ends of spaced upper cantilevered arm sections that are hingedly raisable with respect to lower cantilevered arm sections, the cantilevered arms being rigidly supported by two uprights secured vertically in spaced relation to the gondola display rack. By providing hinged raising of the upper sections with respect to the lower sections, the vertical level of the ends of the slidably mounted display header may be varied and adjusted so as to permit horizontal alignment of the ends of adjacent display headers.

According to another feature of the invention, two spaced brackets may be located at the free ends of the upper sections to accommodate slidable mounting of two adjacently situated display headers side-by-side in a row, at the desired vertical height. This side-by-side mounting arrangement eliminates the need to rearrange an entire row of gondola racks in order to change one or two display headers.

In accordance with a preferred embodiment of the invention, an assembly for cantilevered mounting of a display header to a gondola display rack includes an upright, an arm with a lower section rigidly connected to the top end of the upright and an upper section hingedly raisable with respect to the lower section, and a rearwardly angled bracket located at the free, hingedly raisable end of the upper section, the bracket adapted to receive a slot formed along a side of a display header, thereby to accommodate slidable mounting thereon. Another similar assembly supports the other side of the display header. The upper section is U-shaped in cross section and downwardly opening, and the lower section is U-shaped in cross section and upwardly opening. The upper section fits within the lower section. A bolt threaded upwardly through a hole adjacent the free end of the lower section contacts an underside of the upper section. Upward tightening of this bolt hingedly raises the upper section with respect to the rigidly connected lower section, thereby establishing the vertical height of the ends of the display header.

Preferably, the display header is a triangularly shaped light box with a downwardly or rearwardly angled rear surface, and the bracket and the free end of the upper section have a corresponding rearward angle to accommodate mounting by insertion of the bracket within the header slot, followed by downward and forward sliding of the display header into its final position. By providing two brackets at each upper section free end, two display headers may be mounted alongside one another at the same vertical height.

The assembly is relatively easy to mount to the spaced, hollow vertical standards that are common to most gondola display racks. Each of the vertical uprights of the assembly are open along one side and have two parallel sections with spaced holes in one of these parallel sections. The parallel sections are connected along their lengths by two angled sections. A bolt is extended through a hole at the top of the standard and then through a hole in the interior of the parallel sections of the upright until it contacts the inner surface of the exterior of the parallel sections. The distance between the chosen upright hole and the top end of the upright determines the vertical distance between the cantilevered arm and the gondola rack. Tightening of the bolt forces the parallel sections of the upright outwardly. The bolt itself and the frictional engagement between the outer surfaces of parallel sections and the inner surfaces of the standard hold the upright at the desired height.

With the uprights mounted and the lower sections of the cantilevered arms rigidly connected to the upper ends of the uprights, the upper sections may be hingedly raised with respect to the lower sections to place the brackets at a desired vertical height for slidable mounting of the display header. The display header may be mounted prior to hinged raising of the upper sections. However, this could inadvertently cause the sides of the display header to be supported at two different vertical levels, thereby placing stress upon the display header.

By providing two brackets on each upper section, it is necessary to mount only one additional upright to the next adjacent gondola rack in order to mount another display header alongside the first display header at the desired vertical height. Likewise, for each additional rack and display header, only one additional assembly is required.

These and other features of the invention will be more readily understood in view of the following detailed description and the drawings in which:

DETAILED DESCRIPTION OF THE INVENTION

Figure 1:
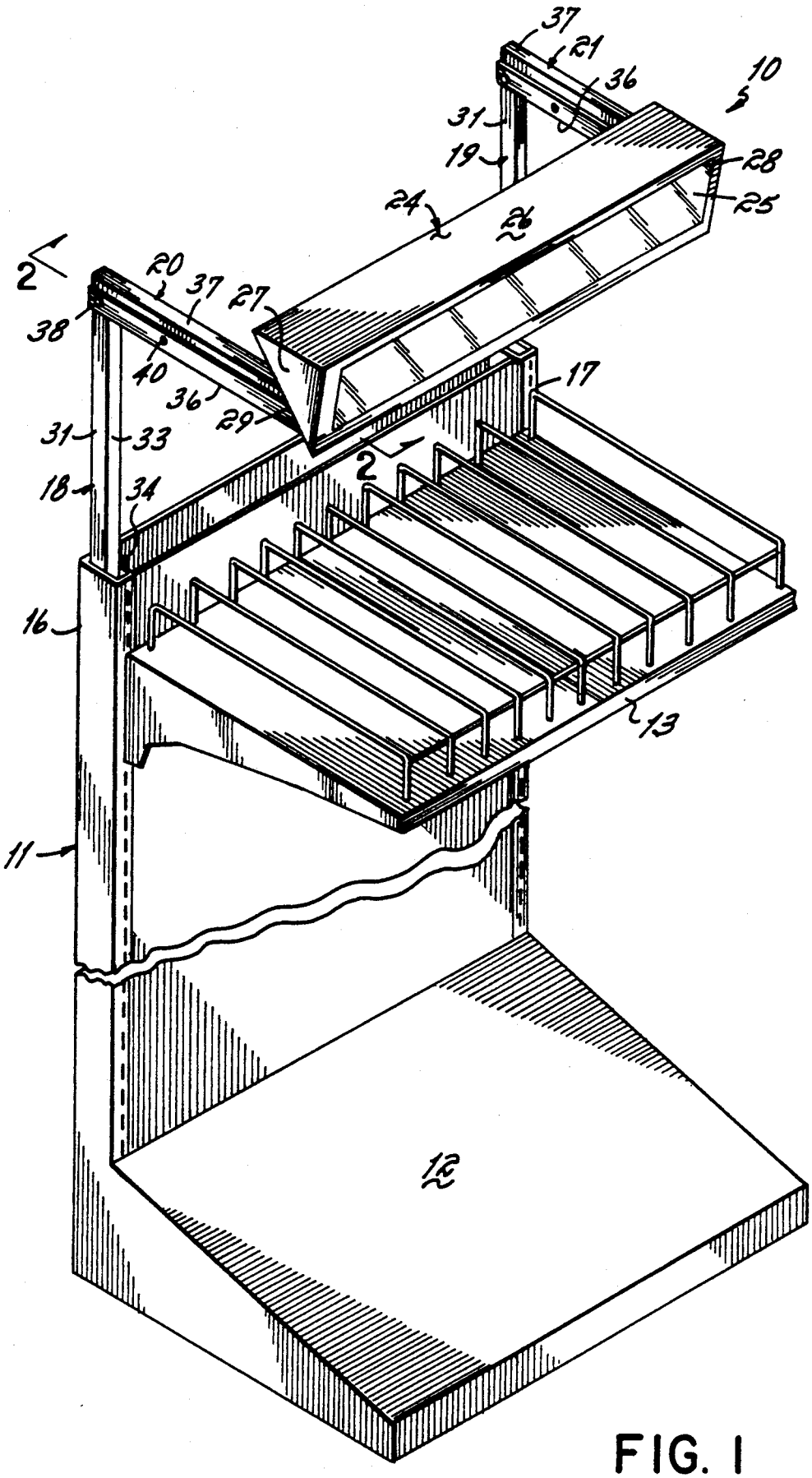
FIG. 1 is a perspective of a display header mounted to a gondola display rack in accordance with a preferred embodiment of this invention.

FIG. 1 shows an assembly, designated generally by numeral 10, for cantilevered mounting of a display header to a gondola display rack 11 in accordance with a preferred embodiment of the invention. The display rack 11 or stand includes a base 12, an uppermost shelf 13 and spaced, hollow vertical standards 16 and 17.

The assembly 10 includes uprights 18 and 19 which frictionally engage standards 16 and 17, respectively, and cantilevered arms 20 and 21 which are rigidly connected to the top ends of uprights 18 and 19, respectively. The free or forward ends of the cantilevered arms 20 and 21 support a display header 24, which preferably is a triangularly shaped light box with a front surface 25, a top surface 26, sides 27 and 28 and a rearwardly angled surface 29.

Figure 2:
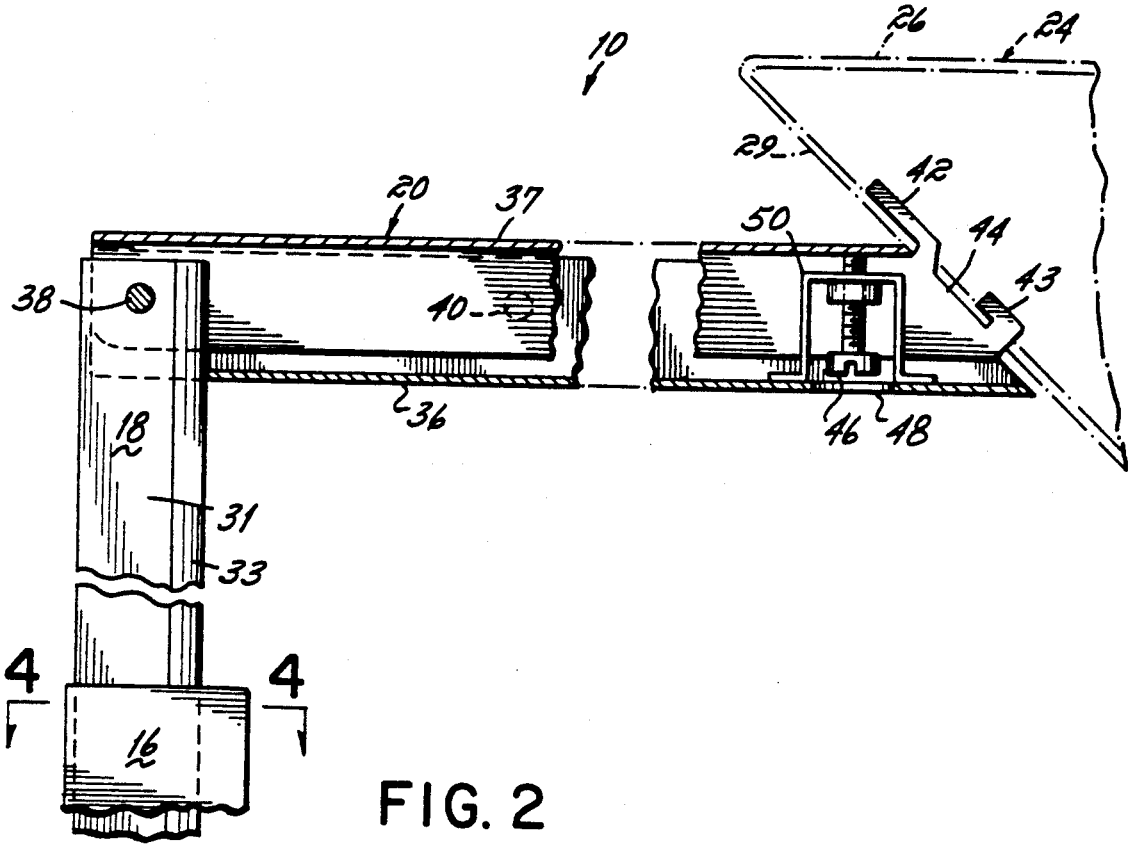
FIG. 2 is a cross-sectional view taken along lines 2—2 of FIG. 1.
Figure 4:
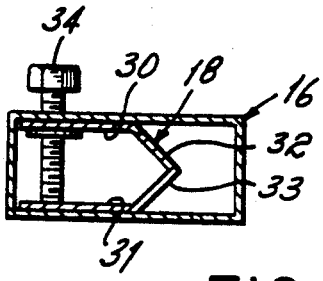
FIG. 4 is a cross-sectional view taken along lines 4—4 of FIG. 2.

FIG. 2 shows the assembly 10 in cross-section with the interconnections between standard 16, upright 18, cantilevered arm 20 and display header 24. FIG. 4 shows a cross sectional view of upright 18, the upright 18 having two parallel sections 30 and 31 interconnected along one side by two angularly disposed sections 32 and 33. Angled sections 32 and 33 enable the parallel sections 30 and 31 to be more easily flexed outwardly or compressed inwardly. Preferably, uprights 18 and 19 are formed by bending a single sheet of metal.

Figure 3:
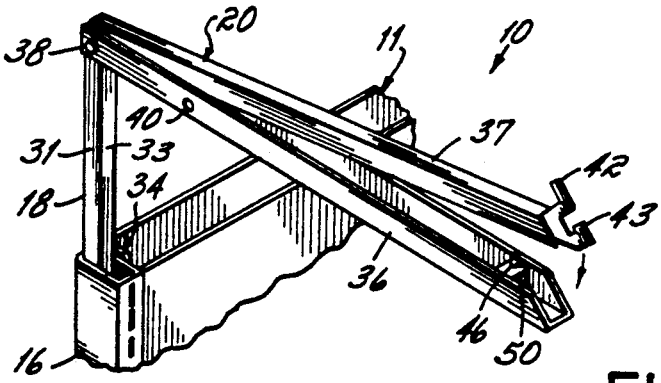
FIG. 3 is a perspective view of upper and lower hingedly connected sections which form part of an assembly for cantilevered connection of a display header in accordance with a preferred embodiment of the invention.

FIGS. 3 and 4 show a bolt 34 extended through an inwardly facing hole (not shown) in standard 16, and further extended through a corresponding hole in section 30 of upright 18 until the end of the bolt 34 contacts an interior surface of section 31. Tightening of the bolt 34 flexes sections 30 and 31 outwardly so that their outer surfaces frictionally bear against the inner surfaces of standard 16. This frictional force, along with the bolt 34 itself, holds the upright 18 in place. Because a number of holes are provided along the length of section 30 and along the interior side of standard 16, the vertical distance between the top of the standard 16 and the bottom of cantilevered arm 20 may be set as desired. Upright 19 is connected to standard 17 in a similar manner.

As shown most clearly in FIG. 3, cantilevered arm 20 includes a lower section 36 and an upper section 37. Upper section 37 is hingedly raisable with respect to lower section 36 about pivot point 38. At the top of upright 18, a cut-out portion of the bottom surface of lower section 36 coacts with sections 32 and 33 to rigidly hold the cantilevered arm 20 in place, with lower section 36 in a horizontal position. An additional set of mounting holes in lower section 36 enables upper section 37 to be connected at point 40, which is located forward (to the right as viewed in FIG. 2) of the top end of the standard 16, thereby enabling the upper section 37 to be hingedly raised about pivot point 40. Ultimately, this enables the display header 24 to be mounted farther forward of the uprights, but also limits the hingedly raisable distance.

At the free end of cantilevered arm 20, upper and lower legs 42 and 43, respectively, define a preferred type of bracket for engagement with slots formed along a side of the rearward surface 29 of the display header 24 (FIG. 2). The legs 42 and 43 are parallel with and extend rearwardly from a rearwardly angled surface 44. Preferably, the relationship between angular surface 29 and angled surface 44 and legs 42 and 43 places the front surface 25 of the display header 24 in a substantially vertical plane so that the display can be more easily seen by customers.

Under some circumstances, it is desirable to change the vertical height of the display header 24. For this purpose, a bolt 46 is threaded upwardly through a nut fixedly secured to the underside of a hat shaped bracket or internal housing 50. The bolt 46 is reached through a hole 48 in lower section 36. With the top end of the threaded bolt 46 in contact with an underside of upper section 37, further tightening hingedly raises upper section 37 with respect to lower section 36, about the pivot point of connection. Once raised, the bolt 46 may be further tightened or loosened to raise or lower the upper section 37, respectively. If a wider degree of variation in height is desired, a longer length bolt 46 may be utilized. Preferably, as shown in FIG. 2, bolt 46 is also threaded through an internal housing 50 that is mounted to lower section 36.

FIG. 3 shows upper section 37 hingedly raised with respect to lower section 36. Upper section 37 is U-shaped in cross-section along its length, with the U-shape directed downwardly. Lower section 36 is also U-shaped, but with the U-shape opening in an upward direction. Upper section 37 is sized to be received within lower section 36 along its entire length. Alternately, lower section 36 may be sized to be received within the upper section 37 along their entire lengths.

Figure 5:
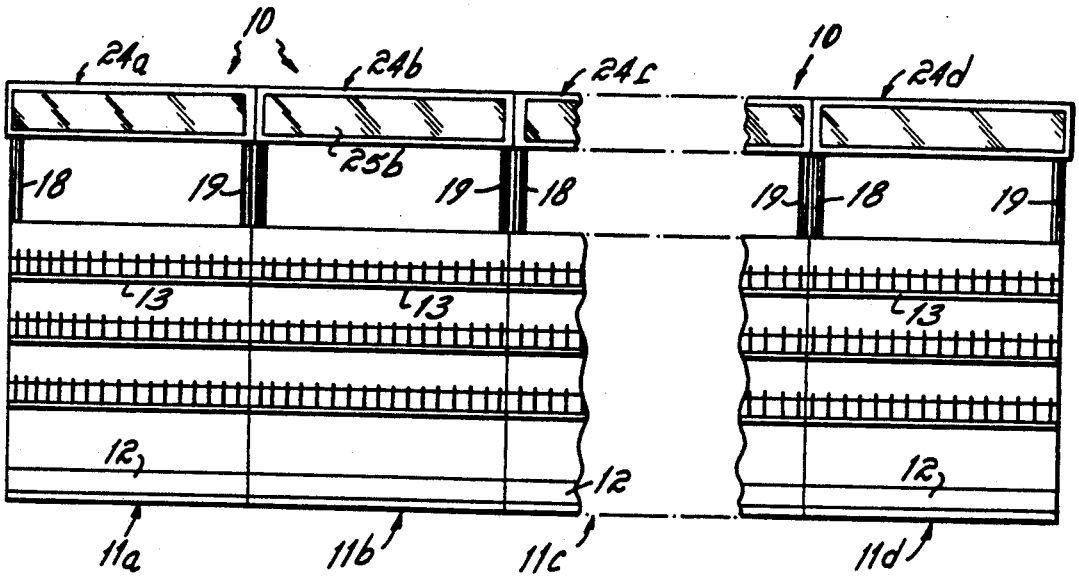
FIG. 5 is a front view of four gondola display racks located side-by-side in a row, each of the racks having a display header mounted thereto in cantilever fashion in accordance with a preferred embodiment of the invention.
Figure 6:
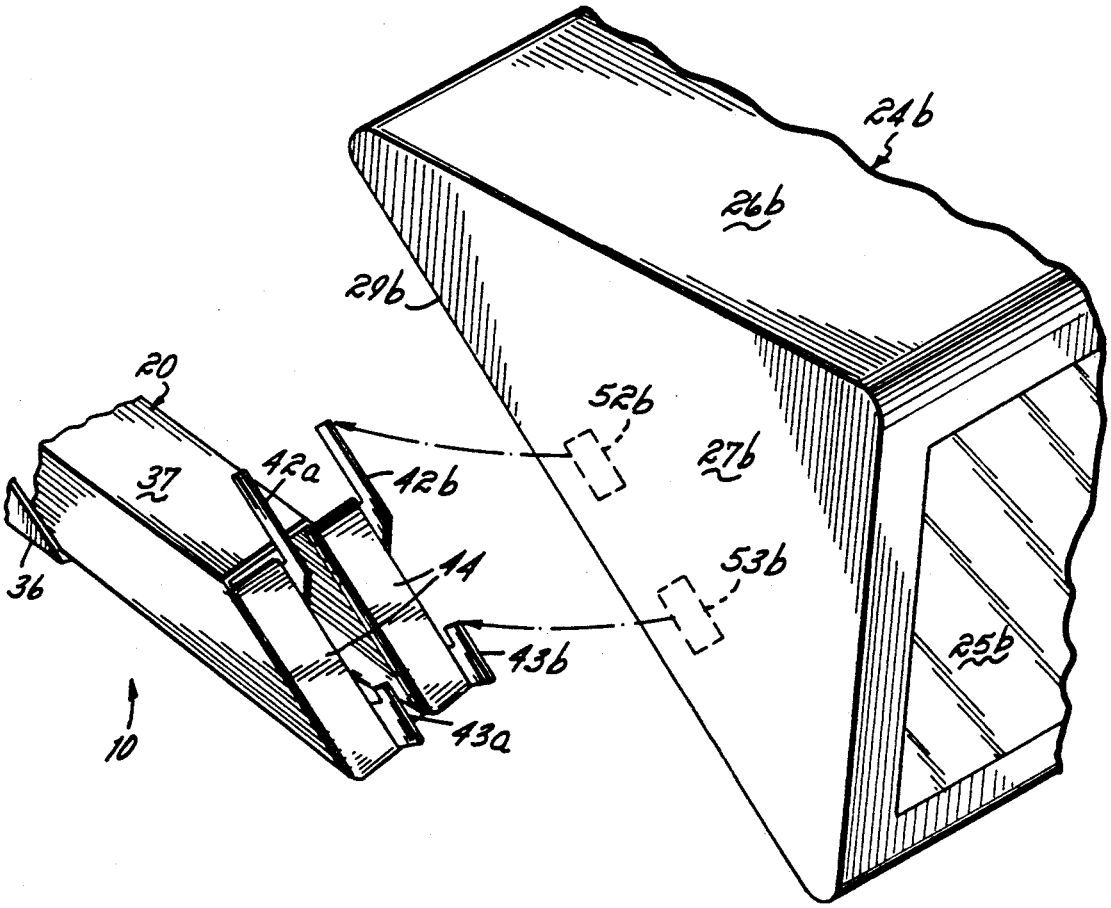
FIG. 6 shows two brackets for mounting two display headers side-by-side at a desired vertical height in accordance with a preferred embodiment of the invention.

FIG. 5 shows a plurality of gondola display racks 11*a*, 11*b*, 11*c* and 11*d* located alongside one another in a row, with cantilevered display headers 24*a*, 24*b*, 24*c* and 24*d* mounted thereto, respectively, and aligned side-by-side in a row at a desired vertical height. The side surfaces of adjacently situated display headers are substantially flush with each other. This flush mounted, side-by-side arrangement is made possible by providing two brackets at the free ends of the upper sections 37 of the cantilevered arms 20. FIG. 6 shows two brackets for adjacent, side-by-side mounting of two display headers to a single cantilevered arm 20. Mounting holes **52*b* and 53*b* formed along one side of back surface 29*b* of cantilevered header 24*b* are placed over legs 42*b* and 43*b*, respectively, and the display header 24*b* is slid downwardly and forwardly into position. Legs 42*a* and 43*a* enable another display header 24*a* as shown in FIG. 5 to be mounted similarly alongside of display header 24*b***, at the desired vertical height.

While a preferred embodiment of the invention has been described, it is to be understood that various modifications could be made without departing from the spirit of the invention. For instance, the shape of the brackets and the slots, or the angles of the surface which support or define the bracket and slots may be varied. Furthermore, this light box, rather than being a closed light box as illustrated in the drawings, may be an open top light box utilizing a reflective surface on the inside of the bottom wall to indirectly light the front wall from an overhead light source. Moreover, structural equivalents may be substituted to perform the same function as the components described herein. Accordingly, it is to be understood that changes may be made without departing from the scope of the invention as particularly set out and claimed.

We claim:

1. An assembly for cantilevered mounting of a display header upon a display rack comprising:

a vertical upright adapted to extend upward from the display rack;

a cantilevered arm rigidly connected to a top end of the vertical upright, the arm including upper and lower hingedly connected sections;

means adapted to connect one side of a display header to a top portion of a free end of the upper section; and means associated with said arm for hingedly raising the upper section with respect to the lower section, thereby to enable one side of the connected display header to be adjustably supported at a desired height.

2. The assembly of claim 1 wherein said upper section is hingedly connected to the lower section at the vertical upright.

3. The assembly of claim 1 wherein said upper section is hingedly connected to the lower section forward of the vertical upright.

4. The assembly of claim 1 wherein said upper section may be hingedly connected to the lower section at one of two selectable locations, the locations being the top end of the vertical upright and a predetermined distance forward of said vertical upright top end.

5. The assembly of claim 1 wherein said lower section is U-shaped in cross-section and opens upwardly and said upper section is U-shaped in cross-section and opens downwardly, the upper section sized to fit within the lower section along the entire length thereof.

6. The assembly of claim 1 wherein the free end of the upper section angles rearwardly.

7. The assembly of claim 6 wherein said means adapted to connect further comprises:

a bracket mounted to said upper section rearwardly angled free end, the bracket sized to be received within a slot formed along one side of the display header.

8. The assembly of claim 7 and further comprising:

an additional bracket located alongside of the first bracket at said upper section free end, thereby to enable two display headers to be supported in side-by-side relation at the desired vertical height.

9. The assembly of claim 1 wherein the extension of said vertical upright above the display rack is adjustable.

10. An assembly for cantilevered mounting of a display header a desired vertical distance above a display rack comprising:

a vertical upright adapted to extend upwardly from the display rack;

a cantilevered arm rigidly connected to a top end of the vertical upright, the arm including a lower horizontal section and an upper section hingedly raisable with respect to the lower section;

means for hingedly raising said upper section with respect to said lower section; and bracket means for supporting adjacent sides of two display headers located side-by-side in a row at the desired distance above said rack.

11. An assembly for cantilevered connection of a display header to a display stand, comprising:

a pair of uprights;

means for securing the uprights in extended, spaced vertical disposition above the display stand;

a pair of arms, each arm rigidly connected to a top end of a vertical upright and each arm further including upper and lower hingedly connected sections;

a pair of brackets, the brackets located at the top of the free ends of the upper sections;

a display header extending between the arms and supported by the brackets; and adjustment means associated with each of the arms, each adjustment means being adapted to hingedly raise an upper section with respect to a lower section, thereby to support the display header at a desired vertical height.

12. The assembly of claim 11 wherein said upper sections are hingedly connected to the lower sections at the top ends of the vertical uprights.

13. The assembly of claim 11 wherein each arm further comprises:

means for hingedly connecting the upper section to the lower section forward of the respective upright top end.

14. The assembly of claim 11 wherein each upper section is U-shaped in cross-section and downwardly opening and each lower section is U-shaped in cross-section and upwardly opening, the upper sections being sized to be received within the lower sections along the entire lengths thereof, and each said adjustment means further comprising a bolt threaded upwardly through the respective lower section to contact an underside of the respective upper section.

15. The assembly of claim 11 and further comprising:

a second bracket located at the free end of the upper section, the brackets adapted to connectably support adjacently situated sides of two display headers mounted in side-by-side relationship at said desired vertical height.

16. A method for cantilevered connection of a display header to a gondola display stand comprising the steps of:

securing a pair of uprights to the stand in spaced, vertical relationship, each upright rigidly supporting a cantilevered arm, and each cantilevered arm including a lower horizontal section and an upper section that is hingedly raisable with respect to the lower section; and mounting a display header to the free ends of the upper sections of the spaced cantilevered arms, thereby to locate said display header at a desired vertical height above the gondola display stand.

17. The method of claim 16 wherein said display header is a triangularly shaped light box with a rearwardly directed angular surface and said upper sections of the cantilevered arms include angled brackets protruding from corresponding rearwardly angled surfaces, wherein the mounting step further comprises:

inserting the spaced brackets into spaced slots formed along the sides of the rearwardly directed angular surface of the light box and sliding the light box forward and downward to the desired vertical height.

18. The method of claim 16 and further comprising the step of:

selecting a desired vertical height of the display header by independently adjusting the positions of the upper sections of the cantilevered arms with respect to the lower sections.

19. The method of claim 16 and further comprising the step of:

connecting one side of a second display header alongside the first display header at one of said cantilevered arms, thereby to provide adjacent side-by-side connection of two display headers at said desired vertical height.

* * * * *